United States Patent [19]

Cendre et al.

[11] Patent Number: 4,848,488

[45] Date of Patent: Jul. 18, 1989

[54] METHOD AND DEVICE FOR ADJUSTING THE PATH OF A DRILLING TOOL FIXED TO THE END OF A SET OF RODS

[75] Inventors: André Cendre, Cosne sur Loire; Jean Boulet, Paris, both of France

[73] Assignee: SMF International, Paris, France

[21] Appl. No.: 173,358

[22] Filed: Mar. 25, 1988

[30] Foreign Application Priority Data

Mar. 27, 1987 [FR] France ..... 87 04322

[51] Int. Cl.[4] ..... E21B 7/08

[52] U.S. Cl. ..... 175/61; 175/76; 175/325

[58] Field of Search ..... 175/61, 73, 76, 324, 175/325

[56] References Cited

U.S. PATENT DOCUMENTS

| | | | |
|---|---|---|---|
| 3,298,449 | 1/1967 | Bachmann et al. | 175/76 |
| 3,424,256 | 1/1969 | Jeter et al. | 175/76 |
| 3,593,810 | 7/1971 | Fields | 175/76 |
| 4,491,187 | 1/1985 | Russell | 175/325 |
| 4,572,305 | 2/1986 | Swietlik | 175/73 |
| 4,635,736 | 1/1987 | Shirley | 175/76 |

FOREIGN PATENT DOCUMENTS

| | | |
|---|---|---|
| 2575793 | 7/1986 | France . |
| 2579662 | 10/1986 | France . |
| 2077811 | 12/1981 | United Kingdom . |

*Primary Examiner*—Thuy M. Bui
*Assistant Examiner*—Terry Lee Melius
*Attorney, Agent, or Firm*—Fay, Sharpe, Beall, Fagan, Minnich & McKee

[57] ABSTRACT

The set of rods comprises at least two stabilizers (5,6) spaced apart along the length of the set of rods (1) and each comprising a body (10), at least one bearing plate (9) and means (21, 23) for actuating the bearing plate (9). The actuating means (21, 23, 21', 23') of each of the stabilizers (5, 6) are controlled independently so as to place the bearing plates (9) of the stabilizers (5, 6) in given positions constituting a combination of positions of extraction of the bearing plates (9) ensuring a desired adjustment of the direction of the set of rods (1).

2 Claims, 2 Drawing Sheets

METHOD AND DEVICE FOR ADJUSTING THE PATH OF A DRILLING TOOL FIXED TO THE END OF A SET OF RODS

The invention relates to a method for adjusting the path of a drilling tool fixed to the end of a set of rods.

It is known to employ for adjusting the path of a drilling tool, devices termed stabilizers which are placed in spaced apart regions along the length of the set of rods in zones usually not far from the drilling tool.

Such stabilizers comprise a body of tubular shape connected to the set of rods, the central bore of which body is in the extension of the bore of the rods for ensuring a continuous circulation of drilling fluid in the set of rods. The stabilizer body carries at least one bearing plate, and usually three bearing plates mounted at 120° to each other to be movable on the body of the stabilizer in radial directions relative to the axis of the set of rods. Means for actuating the bearing plates permits shifting these plates by extraction or retraction in a radial direction so as to place them in a given position where said plates project more or less from the body of the stabilizer. The plates which come to bear against the edges of the drilled hole enable the path of the drilling tool to be adjusted.

A drilling device having a controlled path is known from the French patent application No. 85 04996 published under No. 2,579,662 which may have a plurality of stabilizers in series on the set of rods, the bearing plates of said stabilizers being capable of being placed in successive extraction positions by means of an actuating surface comprising ramps inclined relative to the axis of the set of rods machined on a piston which is mounted to move in translation and in rotation inside the body of the stabilizer.

Such a device is actuated by a control means having the drilling fluid as a source of energy. This control means may be advantageously arranged in the form disclosed in the French patent application No. 85 00142 of Jan. 7, 1985, published under No. 2,575,793. The displacements of the piston producing the extraction of the bearing plates results in a very high increase in the pressure drop in the drilling fluid so that it is possible to determine from the surface the successive positions of the piston, and therefore of the bearing plates by measurements of the pressure of the drilling fluid.

However, in the case where at least two stabilizers are arranged in series on the set of rods, no method and device are known for controlling said stabilizers in such manner as to adjust in a precise manner the path of the drilling tool as a function of the direction measurements effected in the region of the tool. The stabilizers arranged in series are controlled simultaneously for example by acting on the drilling fluid flow rate and the extraction of their bearing plates occurs simultaneously in accordance with a predetermined sequence.

There is therefore available only a relatively small latitude of adjustment, since the number of configurations which may be obtained by extraction of the bearing plates is equal to the number of possible successive positions of these bearing plates.

An object of the invention is therefore to provide a method for adjusting the path of a drilling tool fixed to the end of a set of rods comprising at least two stabilizers disposed in spaced apart relation along the length of the set of rods and each comprising a body connected to the set of rods, at least one bearing plate mounted on the body of the stabilizer to be movable in a radial direction relative to the set of rods, and means for actuating the bearing plate for shifting the bearing plate between at least two stable positions of radial extraction relative to the body, said method permitting a fine adjustment of the path of the tool by increasing the number of possible configurations of the group of stabilizers as concerns the radial extraction of the bearing plates thereof.

For this purpose, the actuating means for each of the stabilizers are controlled independently from one another so as to place the bearing plates of the stabilizers in given positions constituting, for the whole of the stabilizers associated with the set of rods, a combination of positions of extraction of the bearing plates ensuring a desired adjustment in direction of the set of rods.

In order to explain the invention, there will now be described with reference to the accompanying drawings a drilling device comprising two stabilizers for carrying out the method according to the invention.

Figure 1:
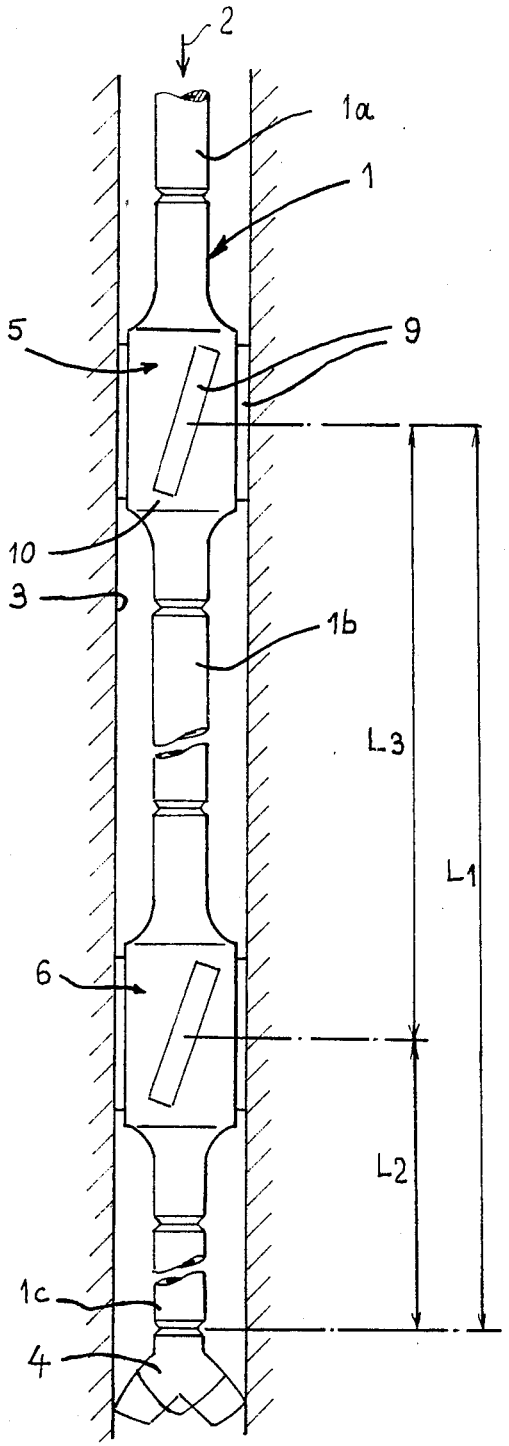
FIG. 1 is an elevational view of the lower part of the drilling device in the operating position in the drilled hole.

FIG. 1 shows the lower part of a set of rods 1 comprising successive rods 1*a*, 1*b*, 1*c* of tubular shape in which flows the drilling mud in the direction of arrow 2. The lower rod 1*c* carries the drilling tool 4 which is rotated by the set of rods 1 and thus drills the hole 3.

A first stabilizer 5 is located between the rods 1*a* and 1*b* and a second stabilizer 6 between the rods 1*b* and 1*c*. The stabilizers 5 and 6 are of the type described in the French patent application No. 85 04996.

The corresponding elements of the stabilizer will be designated by the same reference characters. Each of the stabilizers comprises a body 10 on which are mounted bearing plates 9 which may be inclined relative to the axis 11 of the set of rods corresponding to the axis of the drilled hole.

In the illustrated embodiment, each of the stabilizers comprises four bearing plates arranged at 90° to one another around the body 10 of the corresponding stabilizer. The bearing plates 9 are mounted to be movable relative to the body 10 in radial directions, i.e. in directions perpendicular to the axis 11.

The assembly of the set of rods is effected on the surface and the length of the rods 1*b* interposed between the stabilizers 5 and 6 and 1*c* between the stabilizers 6 and the tool 4 is so chosen as to fix at a desired value the lengths L1 between the median part of the first stabilizer 5 and the tool, L2 between the median part of the second stabilizer 6 and the tool and L3 between the median parts of the stabilizers 5 and 6.

Likewise, the characteristics of the stabilizers will be so chosen as to permit an independent adjustment of the two stabilizers at a distance, as will be described hereinafter.

Figure 2:
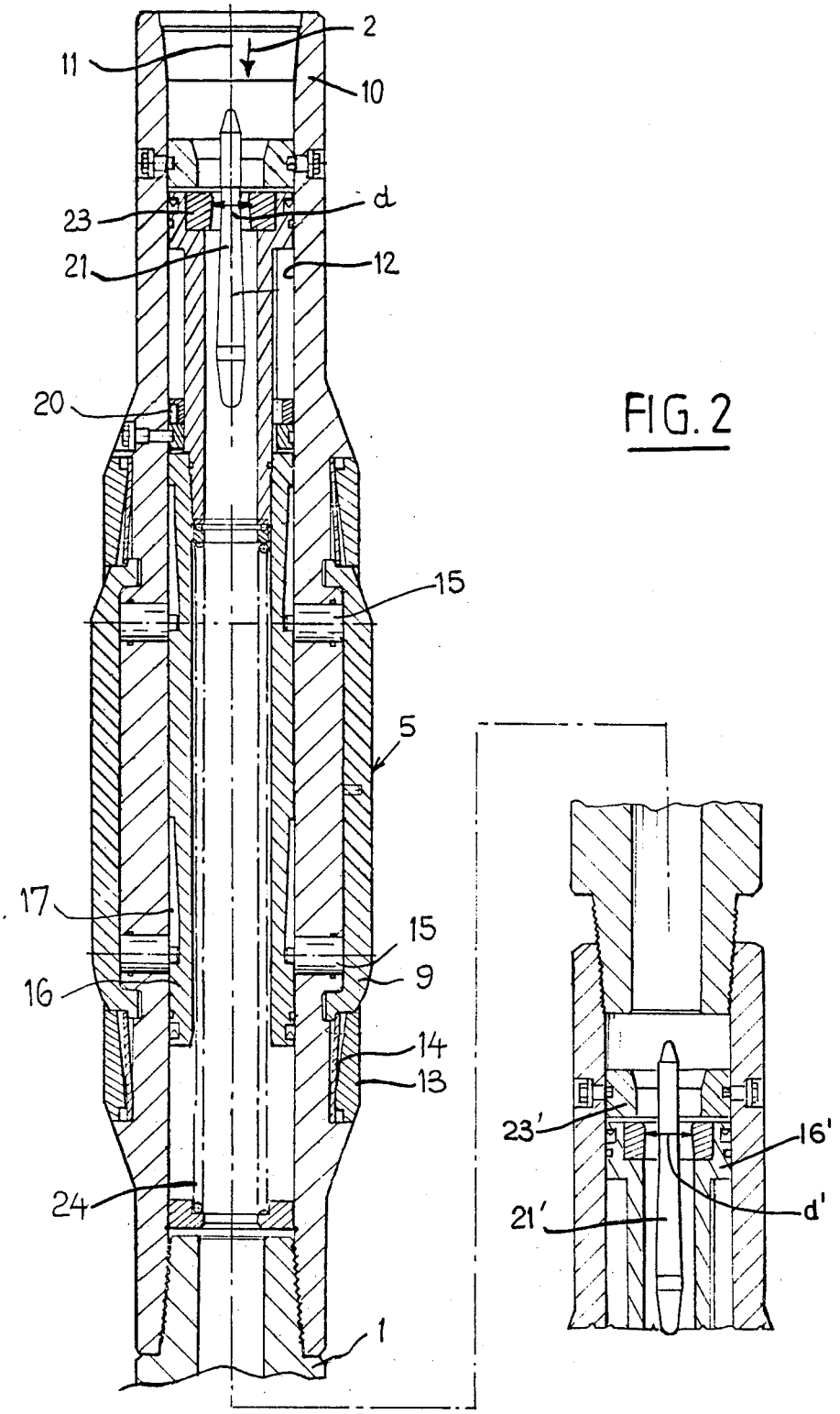
FIG. 2 is an axial sectional view of one of the stabilizers of the device shown on FIG. 1 and of the actuating means for the second stabilizer.

The stabilizers 5 and 6 are of the type described in French application No. 2,579,662, FIG. 2 of the present application reproducing the essential part of FIG. 2 of the aforementioned prior French patent application.

The body 10 of the stabilizer of tubular shape has an inner bore 12 in the extension of the inner bore of the set of rods for ensuring a continuous circulation of the drilling fluid in the axial direction 2.

The body 10 may be directly connected, or connected through junction members to the rods of the set of rods both at the upstream end and downstream end with respect to the direction of circulation of the drilling fluid (arrow 2).

The plates 9 are mounted to be movable in the radial directions relative to the body 10 of the stabilizer and maintained in position by maintaining members 13. The plates are biased to the retracted position by spring strips 14. Each of the plates may be shifted in the radial direction by finger members 15 slidably mounted in the body 10 of the stabilizer and in contact with the plate 9 by one of the ends of the finger members.

A tubular actuating piston 16 is mounted to be movable in axial translation and in rotation about the axis 11 inside the bore 12 of the body 10. The piston 16 is machined on its outer lateral surface so as to constitute ramps 17 inclined in a radial direction relative to the axis 11 of the set of rods. The finger members 15 are engaged with the ramps 17 by the ends thereof opposed to their end in contact with the inner side of the bearing plate 9.

It will be readily understood that an axial displacement of the piston results in a displacement of the finger members in the radial direction owing to the action of the ramps 17.

For example, shifting the piston 16 downwardly as viewed in FIG. 2 results in an extracting movement, i.e. a radially outward movement of the finger members 15 and the bearing plates 9.

As disclosed in the aforementioned patent application No. 2,579,662, ramps 17 of variable inclination are machined around the piston 16 and are connected by complementary parts having a constant level in the radial direction which comprise straight parts for the return of the piston 6 and curved parts permitting the piston to be rotated inside the bore 12 and allow it to effect a step presenting the finger members of the bearing plates at the entrance of a new ramp.

Thus it is possible to obtain, according to what is described in said French patent application No. 2,579,662, a variable extraction of the bearing plates by putting the finger members 15 in contact with a part of the actuating surface at a certain region in the radial direction, the passage from one region to another being effected by means of the ramps 17.

A freewheel 20 allows the rotation of the piston in a single direction and permits ensuring a given sequence of the positions of extraction of the bearing plates by successive displacements of the piston in the bore 12; the sequence of extraction is determined by the shape of the actuating surface and in particular by the inclination and the position of the ramps 17.

The displacements of the piston in axial translation in the direction of arrow 2 are controlled by a pressure drop device constituted by a profiled body 21 extending axially and termed needle member and an annular profiled member 23. The needle member 21 is fixed to the body 10 on the axis of the bore 12 and the annular member 23 is connected to the tubular piston 16 of which it constitutes a part of the inner surface in which the drilling fluid flows. The piston 16 is mounted in the body 10 in such manner that the member 23 is located around the needle member 21.

The drilling fluid flowing in the direction of arrow 2 must pass, upon its entry into the tubular piston 1, in the annular space defined between the needle member 21 and the annular member 23. There results a pressure drop which is manifested by a difference in pressure on each side of the piston 16 in the axial direction.

The piston 16 is maintained in the position shown in FIG. 2, the finger members 15 being in contact with the ramps 17 at one of their ends, both by a return coil spring 24 and the spring strips 14 of the bearing plates 9 acting on the piston 16 through the finger members 15.

The piston 16 can only move in the axial direction and in the direction of arrow 2 if the force exerted by the drilling fluid on this piston exceeds a certain limit, i.e. if the pressure difference on each side of the piston itself exceeds a certain given limit.

The characteristics of the stabilizer and in particular the diameters of the needle member 21 and the annular member 23 are so determined that the displacement of the piston in the axial direction and in the direction of arrow 2 occurs for an actuating flow rate Qactl which is distinctly higher than the normal drilling flow rate Qfor.

The device therefore operates in the following manner:

When it is desired to shift the bearing plates 9, for example to extract these plates, the drilling fluid flow rate is increased to a value at least equal to Qact1 and usually a little higher than the latter. The piston 16 is then shifted in the direction of arrow 2, which causes an extraction of the plates by the cooperation between the finger members 15 and the ramps 17. The length of the displacement of the piston 16 corresponds to the length of the ramps so that, at the end of the displacement of the piston, the finger members 15 have reached the upper end of the ramps 17.

The profile of the needle member 21 having an increasing diameter cooperates during the displacement of the piston with the annular member 23 so as to increase the pressure drop in the drilling fluid. The pressure of the drilling fluid which may be measured from the surface considerably increases at the end of the movement in translation of the piston. Thus, it is possible to ascertain from the surface the position of the piston corresponding to the position of the finger members at the end of the ramps. The finger members 15 then come in contact with a curved part of the actuating surface which produces a rotation of the piston 16 about the axis 11 in the direction allowed by the freewheel 20 in accordance with a displacement step in rotation. The finger members 15 are then in alignment with the complementary parts at constant level of the actuating surface.

If the flow of the drilling fluid is then stopped by stopping the pumping, the force maintaining the piston in position is eliminated and the spring 24 moves the piston in translation in the direction opposed to the arrow 2. The finger members 15 travel along complementary parts of constant level of the actuating surface and come to a stable position the level of which corresponds to the level of the upper end of the ramps 17.

The bearing plates are then maintained in a stable position of extraction by the finger members 15.

If the position of extraction of the stabilizer corresponds to the chosen position, the drilling fluid flow rate is re-established in the set of rods and the drilling is pursued and the adjustment of the path is ensured by the stabilizer 5 in the position of extraction.

If the position of extraction obtained by the first cycle of displacement of the piston is not the chosen position, a second cycle of displacement is effected in the same way as before by raising the rate of flow up to the value Qactl.

The device described by way of example in French patent No. 2,579,662 thus comprises three stable positions of extraction of the bearing plates 9.

The same is true of the stabilizers 5 and 6 of the present embodiment of the invention each of which comprises three stable positions of extraction.

As is shown in the lower part of FIG. 2, the second stabilizer 6 comprises a needle member 21' identical to the needle member 21 of the actuating device of the first stabilizer 5. On the other hand, the actuating device of the second stabilizer 6 includes an annular member 23', connected to its piston 16' whose minimum inside diameter d' is substantially greater than the minimum inside diameter d of the annular member 23 of the actuating device of the stabilizer 5.

Consequently, the actuating flow rate Qact2 of the stabilizer 6 is higher than the actuating flow rate Qact1 of the stabilizer 5, the pressure drop which varies with the flow rate being greater in the region of the annular section of passage having an outside diameter d than in the region of the annular section of passage having an outside diameter d'.

The actuating devices of the stabilizers 5 and 6 as just described permit regulating independently of each other the stabilizers 5 and 6 in one of their positions of extraction as will be described hereinafter.

There will be designated hereinafter by $\phi$1, $\phi$2 and $\phi$3 the outside diameters of the stabilizer 5 whose plates have been placed in their three successive positions of extraction respectively. These diameters correspond to the three possible configurations of the stabilizer 5.

Likewise, the outside diameters or possible configurations of the second stabilizer 6 will be designated by $\phi'$1, $\phi'$2 and $\phi'$3.

It will be assumed that the stabilizer 5 has been placed in one of these configurations, for example the configuration $\phi$2, by the previously-described procedure. When the position $\phi$2 is reached, the drilling flow is eliminated, the piston 16 of the stabilizer 5 then returns to its departure position. The stabilizer 5 is then in its stable position corresponding to the configuration $\phi$2.

The drilling fluid flow rate is then increased from the surface up to a value at least equal to Qact2 and usually a little higher. The pistons 16 and 16' are then shifted in such manner as to put the bearing plates of the stabilizers 5 and 6 in new positions, after elimination of the flow, the stabilizers 5 and 6 are in new stable positions corresponding for example to the configurations $\phi$3 and $\phi'$1 respectively.

If this combination corresponds to the desired combination, the drilling flow Qfor is re-established and the drilling operation is pursued with the desired adjustment of the path.

If the combination obtained is not the desired combination, the stabilizers are continued to be actuated by raising the actuating flow to a level higher than Qact1 and lower than Qact2 or to a level higher than Qact2. For example, to obtain the combination $\phi$2, $\phi'$2, the following operations are carried out:

raising of the flow to Qact2 (or a little above), elimination of the flow (the combination obtained is then $\phi$1, $\phi'$2), raising the flow to Qact1, elimination of the flow (the combination obtained is then $\phi$2, $\phi'$2).

The drilling flow Qfor can then be re-established and the drilling operation pursued with the required path adjustment.

The successive positions of the pistons 16 and 16' may be ascertained from the surface by measuring pressure, the pressure drops between the members 23 and 23' and the needle member 21 and 21' respectively being very high when the piston has finished its displacement under the effect of the drilling fluid.

The independent adjustment of the configurations of the stabilizers 5 and 6 permits obtaining nine different combinations associating a configuration of the stabilizer 5 with a configuration of the stabilizer 6.

These configurations may be designated by :

$\phi$1, $\phi'$1, $\phi$1 $\phi'$2, $\phi$1 $\phi'$3 . . .

By way of comparison, in the case of stabilizers controlled simultaneously there will be obtained only three different configurations and therefore a much smaller possibility of adjustment.

In the case of the device disclosed in French patent application No. 2,579,662, the three different configurations for the extraction of the bearing plates of the stabilizer corresponded to levels of the actuating surface situated respectively at 11 mm, 6 mm and 4.5 mm below the outer nominal surface of the piston of the stabilizer. In the case of the method and device according to the present invention, the same actuating levels will be chosen, so that the diameters $\phi$1, $\phi$2, $\phi$3 and $\phi'$1, $\phi'$2 and $\phi'$3 will be respectively equal to:

D, D+10 mm, D+13 mm where D designates the minimum diameter of the stabilizer.

The process according to the invention therefore affords a great latitude of adjustment of the drilling path with a small number of stabilizers which may be equal to two, each of the stabilizers having itself a number of adjustment configurations which may be small.

The scope of the invention is not intended to be limited to the described embodiment.

Thus, the use of more than two stabilizers in series may be imagined, for example three stabilizers, and for each of these stabilizers any number of positions of adjustment in diameter.

At a minimum, there will be employed a group of two stabilizers each having two different positions of adjustment. In this case, four different configurations of adjustment corresponding to the combinations of the two diameters of the two stabilizers will be available.

In the case of three stabilizers each having three positions of adjustment, twenty-seven configurations of adjustment are provided.

However, it is very difficult to control a relatively large number of stabilizers, for example exceeding three, since the successive actuating flow rates Qact1, Qact2, Qact3 . . . must be very distinctly different from one another and markedly higher than the normal drilling flow rate. In order to control a large number of stabilizers, it would therefore be necessary to have a very wide ranger of adjustment of the flow rate, which is usually not the case in the conventional drilling installations.

The method according to the invention is not intended to be limited to the use of a hydraulic control of the pressure-drop type for actuating the various stabilizers arranged in series. It is possible to image the use of other controls of hydraulic type, for example the use of valves or other closure members which are introduced in the set of rods for actuating the stabilizers. Such devices are however less flexible and more difficult to use than the pressure drop devices controlled from the surface.

Other hydraulic or pneumatic control means could also be imagined or even electric control means each associated with the stabilizers.

The stabilizers may be of a type different from that disclosed in the French patent application No. 85 04996 and comprise, for example, pistons which are shifted solely in translation and have ramps for extracting finger members actuating bearing plates aligned along the length of the piston.

The invention is applicable to any case where it is desired to adjust and control the path of a drilling tool.

We claim:

1. A device for adjusting the drilling path of a drilling tool combined with and fixed to an end of a set of axially aligned hollow rods in which a drilling fluid can flow, comprising:

at least two stabilizers disposed in spaced relation along a longitudinal axis of the set of rods, each stabilizer comprising:

a tubular body connected to the set of rods;

at least one bearing plate mounted on an outer periphery of said tubular body so as to be radially movable relative to said body into at least two predetermined positions of extension; and, means for actuating the at least one bearing plate for placing said bearing plate in one of the at least two positions of extension, said means for actuating comprising:

a tubular piston having a longitudinal axis and a bore extending through said piston along said piston axis, said piston being mounted in said tubular body so as to be movable in axial translation and in rotation about the axis of the set of rods, the tubular piston having a profiled portion along said inner bore, longitudinal grooves having bottom surfaces inclined in a radial direction relative to the axis of the set of rods, said grooves being provided on an outer surface of said tubular piston, an actuating finger member interposed between a tubular piston longitudinal groove and the at least one bearing plate for transmitting movement from said tubular piston to said at least one bearing plate, a profiled body secured in said tubular body on the axis of said tubular piston and adapted to cooperate with said piston profiled portion to define an annular passage through said tubular body for the flow of drilling fluid, said passage having size which varies along said piston axis, wherein said means for actuating said at least one bearing plate of a first stabilizer of the at least two stabilizers is controlled independently of the corresponding actuating means of a second stabilizer of the at least two stabilizers, such differential control of said first and second stabilizers being possible because an annular passage defined in a tubular body of said first of said at least two stabilizers is different in size than an annular passage defined in a tubular body of said second of said at least two stabilizers, thereby allowing each of said at least two stabilizers to be separately actuated so as to place the bearing plates of said stabilizers in given positions constituting for all of the stabilizers disposed along the length of the set of rods a combination of positions of radial extension of the bearing plates ensuring a desired adjustment of the direction of the set of rods.

2. The device according to claim 1, wherein a profiled portion of a tubular piston of an actuating means of said first stabilizer has a minimum inside diameter which is different in size from a minimum inside diameter of a profiled portion of a tubular piston of an actuating means of said second stabilizer.

* * * * *